US006281641B1

(12) United States Patent
Chen et al.

(10) Patent No.: US 6,281,641 B1
(45) Date of Patent: Aug. 28, 2001

(54) ELECTRONIC BALLAST FOR ONE OR MORE LAMPS

(75) Inventors: Daoshen Chen, Huntsville; Bryce L. Hesterman, Madison, both of AL (US)

(73) Assignee: Universal Lighting Technologies, Nashville, TN (US)

( * ) Notice: Subject to any disclaimer, the term of this patent is extended or adjusted under 35 U.S.C. 154(b) by 0 days.

(21) Appl. No.: 09/562,158

(22) Filed: May 1, 2000

(51) Int. Cl.[7] ..... G05F 1/00

(52) U.S. Cl. ..... 315/307; 315/224; 315/209 R; 315/291; 315/127; 315/DIG. 7

(58) Field of Search ..... 315/94, 99, 101, 315/106, 224, 209 R, 307, 291, DIG. 7, 127

(56) References Cited

U.S. PATENT DOCUMENTS

| | | | | |
|---|---|---|---|---|
| 5,563,473 | * | 10/1996 | Mattas et al. | 315/240 |
| 5,635,799 | | 6/1997 | Hesterman | 315/127 X |
| 5,751,115 | * | 5/1998 | Jayaraman et al. | 315/225 |
| 5,877,592 | * | 3/1999 | Hesterman et al. | 315/106 |
| 5,973,455 | * | 10/1999 | Mirskiy et al. | 315/105 |

OTHER PUBLICATIONS

European Patent Application No. 94104797.9 filed Mar. 25, 1994, by Applicant Toshiba Lighting & Technology Corporation.

European Patent Application No. 84105786.2 filed May 21, 1984 by Applicant Siemens Aktiengesellschaft.

* cited by examiner

*Primary Examiner*—Haissa Philogene
(74) *Attorney, Agent, or Firm*—Waddey & Patterson; Mark J. Patterson

(57) ABSTRACT

An electronic ballast apparatus for powering one or more gas discharge lamps includes an inverter that is controlled by an inverter control circuit. The inverter control circuit adjusts certain ballast operating characteristics in order to operate the lamps under nearly the same operating conditions irrespective of how many lamps are connected to the ballast. The inverter control circuit includes a lamp quantity sensor, a regulator circuit and an end-of-lamp-life sensor. The lamp quantity sensor provides a lamp quantity signal that indicates how many lamps are connected to the ballast. The regulator circuit includes a reference adjustment circuit that receives the lamp quantity signal and provides a scaled reference signal to a reference terminal of an error amplifier. The error amplifier also has a feedback terminal that receives a signal that is proportional to the power delivered by the inverter to the lamps. The regulator circuit provides a signal to an inverter power control circuit to ensure that the total power delivered by the inverter to the lamps is proportional to the number of lamps connected to the ballast. The lamp quantity signal is also used to adjust the operation of the end-of-lamp-life sensor.

20 Claims, 2 Drawing Sheets

ELECTRONIC BALLAST FOR ONE OR MORE LAMPS

BACKGROUND OF THE INVENTION

The present invention relates generally to electronic ballasts, and more particularly, this invention pertains to an electronic ballast that can be wired to operate multiple lamps.

Typical electronic ballasts have a source of DC power, an inverter, and a resonant circuit. A series resonant tank circuit is commonly used to operate two or more fluorescent lamps connected in series. Further prior art is found in U.S. Pat. No. 5,635,799 issued to Hesterman on Jun. 3, 1997 which discloses a "lamp Protection Circuit for Electronic Ballasts." This patent is hereby incorporated by reference. The disclosure of the patent shows several series-connected two-lamp ballast circuits having a series resonant tank circuit and end-of-lamp-life sensor. The disclosure of this patent has a limitation because if one lamp were to be operated instead of two lamps, the lamp current would go up, and the end-of-lamp-life sensor would not operate properly.

What is needed is a ballast that can sense how many lamps are present, and adjust an inverter control circuit to maintain essentially equivalent operation regardless of how many lamps are connected.

SUMMARY OF THE INVENTION

The present invention is directed towards an electronic ballast apparatus for powering one or more gas discharge lamps. The electronic ballast includes an inverter that is controlled by an inverter control circuit. The inverter control circuit adjusts certain ballast operating characteristics in order to operate one or more lamps under nearly the same operating conditions irrespective of how many lamps are connected to the ballast. The inverter control circuit includes a lamp quantity sensor, a regulator circuit and an end-of-lamp-life sensor. The lamp quantity sensor provides a lamp quantity signal that indicates how many lamps are connected to the ballast. The regulator circuit includes a reference adjustment circuit that receives the lamp quantity signal and provides a scaled reference signal to a reference terminal of an error amplifier. The error amplifier also has a feedback terminal that receives a signal that is proportional to the power delivered by the inverter to the lamps. The regulator circuit provides a signal to an inverter power control circuit to ensure that the total power delivered by the inverter to the lamps is proportional to the number of lamps connected to the ballast. Regulating the lamp power has the effect of controlling the lamp current because the voltage across the lamps is relatively constant. Alternative embodiments may utilize other control methods including a feedback signal adjustment circuit connected to the lamp quantity sensor in combination with a fixed reference input to the error amplifier to achieve the same results.

The output of the lamp quantity sensor is also used to adjust an end-of-lamp-life sensor so that it will properly sense the end-of-lamp-life condition for one or two lamps. In alternative embodiments, additional lamp quantity sensors may be connected together to create an overall lamp quantity signal appropriate for use in ballasts that are capable of operating more than two lamps.

DESCRIPTION OF THE PREFERRED EMBODIMENTS

Figure 1:
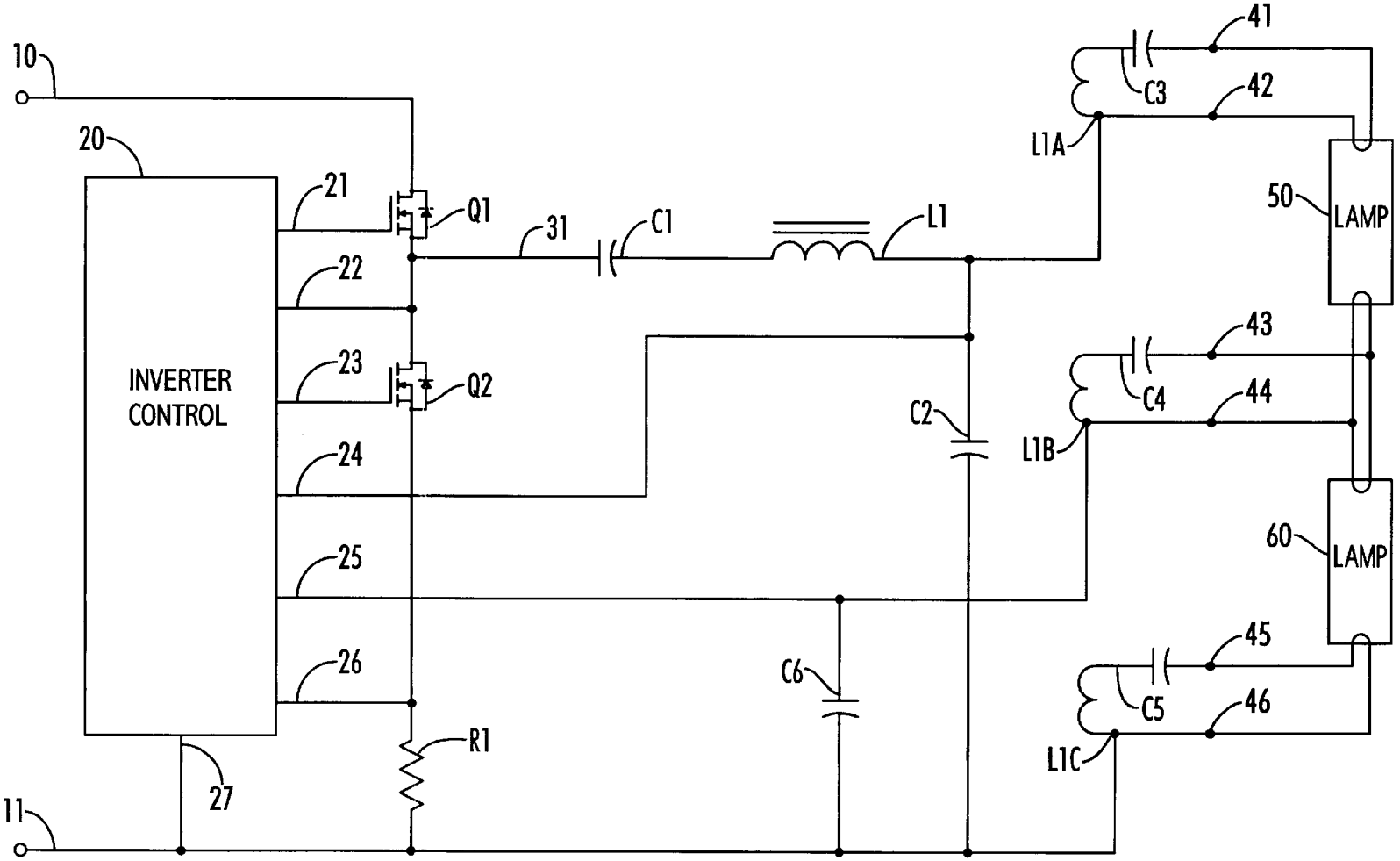
FIG. 1 shows a simplified schematic diagram of an electronic ballast.

FIG. 1 shows a simplified schematic diagram of the electronic ballast apparatus of the present invention for powering one or more gas discharge lamps 50, 60. A source of dc power (not shown) is connected between positive terminal 10 and negative terminal 11. An inverter control circuit 20 provides gate drive signals to a half-bridge inverter comprising MOSFET transistors Q1 and Q2 through terminals 21, 22, 23, and 27. The source of transistor Q2 is connected to negative terminal 11 through a current sensing resistor R1. The inverter control circuit 20 alternately turns on transistors Q1 and Q2 to form a square wave signal at inverter output terminal 31. The frequency of the square wave signal is typically between 20 and 200 kHz.

A series resonant tank circuit is comprised of a dc blocking capacitor C1, a resonant inductor L1, and a resonant capacitor C2. The series resonant tank circuit is connected between inverter output terminal 31 and negative terminal 11. There are several known ways that a series-resonant tank circuit may be configured that are essentially equivalent, such as interchanging the order of the elements, or substituting the connection to the negative power supply terminal 11 with a connection to the positive power supply terminal 10. Full bridge inverters may also be used in place of the half-bridge inverter.

A first ballast output terminal 42 is connected to the junction of inductor L1 and capacitor C2. A second ballast output terminal 44 is coupled to negative terminal 11 through a starting aid capacitor C6. A third ballast output terminal 46 is connected to negative terminal 11. A set of optional filament heating windings L1A, L1B, and L1C, which are coupled to inductor L1, provide filament heating power to ballast output terminals 41, 43, and 45. By connecting lamps 50, 60 to various terminals, the power output from the inverter may be used to power one or more lamps. A first lamp 50 and a second lamp 60 may be connected to the ballast output terminals as shown in FIG. 1. Alternatively, a single lamp may be connected between terminals 41 and 42, and terminals 45 and 46.

The inverter control circuit 20 operates each transistor with about a fifty-percent duty cycle, with a dead time between the time when one transistor is turned off and the other transistor is turned on. The inverter control circuit 20 has three sensing terminals 24, 25, and 26 that are connected to internal circuits that modify the operation of the inverter according to whether one or more lamps are connected to the ballasts. These sensing terminals include a lamp quantity sensing terminal 25 connected to a lamp quantity sensor 6, a current sense terminal 26 connected to a regulator circuit 4, and an end-of-lamp-life sensor terminal 24 connected to an end-of-lamp-life sensor 8.

Figure 2:
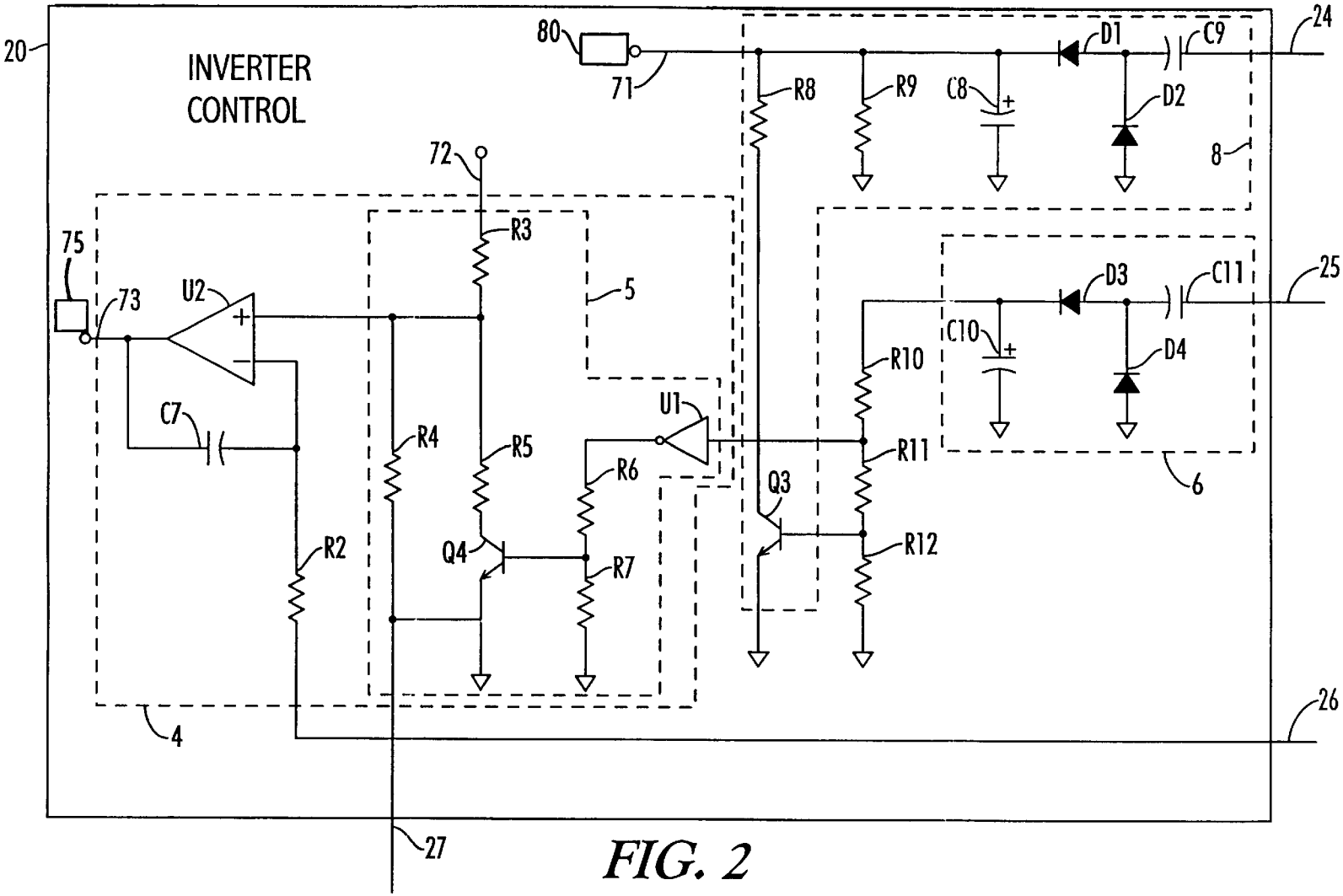
FIG. 2 shows a partial schematic diagram of the inverter control circuit shown in FIG. 1.

Lamp quantity sensing terminal 25 is electrically connected to a series connection point 44, also known as ballast output terminal 44, where first lamp 50 and second lamp 60 are connected in series. As shown in FIG. 2, lamp quantity sensor 6 is connected to lamp sensing terminal 25, thereby connecting lamp quantity sensor 6 to series connection point 44. When two lamps are connected and operating, the lamp quantity sensor 6 senses the high-frequency ac voltage between terminal 44 and a common terminal 27 that is connected to negative power supply terminal 11. When the ballast is installed in a fixture intended for only one lamp, terminals 43 and 44 are left unconnected. If output wires are used instead of terminals 43 and 44, these wires should be cut short and capped to prevent stray signals from entering terminal 25.

When two lamps 50, 60 are connected and operating, the high-frequency ac voltage present at terminal 25 is converted to a dc voltage by a charge pump consisting of a capacitor C11, diodes D3 and D4, and capacitor C10. The voltage across C10 is the output, also known as the lamp quantity signal, of the lamp quantity sensor 6. For the particular implementation shown in FIG. 2, it was convenient to scale this voltage with a voltage divider comprised of resistors R10, R11, and R12. The voltage at the junction of resistors R10 and R11 is applied to the input of a digital inverter U1 that is used to detect the threshold. The voltage at the junction of resistors R11 and R12 is applied to the base of a transistor Q3 that is used to control a charge pump load for the end-of-lamp-life sensor.

When one lamp is connected and operating, terminals 43 and 44 are disconnected. Ideally, no signal is delivered to lamp quantity sensor 6 from terminal 44, but in practice stray signals may be coupled to terminal 44. Because stray or false signals are generally of short or limited duration, a false triggering delay is provided by a time delay device implemented by capacitor C10 to provide a delay in the operation of the lamp quantity sensor so that transient voltages at terminal 25 will not cause false triggering. The starting aid capacitor C6, shown in FIG. 1, also helps to reduce the effects of stray extraneous signals at terminal 44 by shunting high frequency signals to terminal 27.

If a ballast were to be designed to operate three lamps in series, a first lamp quantity sensor could be connected to a first common point between the first and second lamps, and a second lamp quantity sensor could be connected to a second common point between the second and third lamps. The outputs of the first and second lamp quantity sensors may be combined to form an overall lamp quantity signal.

It may seem that a good alternative approach to sensing the common point or points between series connected lamps would be to sense the overall voltage across the series combination of the lamps since that voltage is proportional to the number of lamps. The problem with that solution is that when a lamp reaches the end-of-life condition, its arc voltage increases, and this could cause the lamp quantity signal to give a false reading.

Current sense terminal 26 is connected to current sense resistor R1 and regulator circuit 4 which includes an error amplifier U2 and a reference adjustment circuit 5. The average voltage across R1 is proportional to the current supplied to the inverter through positive terminal 10. If the voltage between positive terminal 10 and negative terminal 11 is relatively constant, then the average voltage across R1 will be proportional to the power supplied to the lamps by the inverter.

Current sense terminal 26 is coupled to the feedback terminal, also known as an inverting terminal, of the error amplifier U2 through a resistor R2. An integrating capacitor C7 is connected between the inverting input terminal and the output of the error amplifier U2. The reference terminal, also known as a non-inverting terminal, of error amplifier U2 is connected to a reference adjustment circuit 5. A voltage reference (not shown) supplies a reference signal to a reference terminal 72. In this particular implementation, the reference signal has value of two volts. Reference adjustment circuit 5 scales the reference signal according to the quantity of lamps detected.

Inverter control 20 has an inverter power control circuit 75 that controls the output power of the inverter in response to the voltage between terminals 73 and 27. The output of error amplifier U2 is connected to the inverter power-control circuit 75 at terminal 73. The inverter power control circuit 75 is configured so that the output power of the inverter will increase when the voltage between terminal 73 and common terminal 27 increases. This allows the error amplifier to adjust the output power of the inverter so the inverter current feedback signal at terminal 26 matches the scaled reference signal. Consequently, the total power delivered by the inverter to the lamps is proportional to the number of lamps connected to the ballast. Regulating the lamp power has the effect of controlling the lamp current because the voltage across the lamps is relatively constant. Regulator circuit 4 therefore maintains essentially the same lamp current irrespective of the number of lamps connected. Alternative embodiments may utilize other control methods including a feedback signal adjustment circuit connected to the lamp quantity sensor in combination with a fixed reference input to the error amplifier to achieve the same results.

In the preferred embodiment, the inverter power control circuit 75 (not shown) controls inverter output power by adjusting the frequency of the inverter output signal at terminal 31. In alternative embodiments, the inverter power control circuit 75 may have provisions for adjusting the duty cycle symmetry and/or the dead time. These various control method may be used to control the lamp current. For frequency control, and symmetry control, the ballast is preferably operated at frequencies above the resonant frequency of the series resonant tank. The resonant frequency of the resonant tank is defined as the frequency at which the current drawn by the resonant tank from terminal 31 is in phase with the inverter output voltage. The lamp load connected to the ballast affects the resonant frequency. For dead time control, the inverter 20 is preferably operated near the resonant frequency of the series resonant tank. Increasing the inverter frequency above resonance or increasing the dead time decreases the lamp current. Shifting the symmetry of the inverter output signal away from fifty percent also decreases the lamp current.

As shown in FIG. 2, reference adjustment circuit 5 includes a threshold detector U1 that is connected to lamp quantity sensor 6. In the preferred embodiment, threshold detector U1 is a digital inverter, while an alternative embodiment could use a comparator.

The following discussion outlines the operation of the reference adjustment circuit 5. The voltage at the junction of resistors R10 and R11 is applied to the input of a digital inverter U1 that is used to detect whether the lamp quantity signal is greater than a threshold. A CMOS inverter such as a standard 4106 type may be used for U1. A more accurate threshold detector could be implemented with a comparator. The threshold detector operates as follows: when the voltage across C10 is greater than a first predetermined level, the output of the inverter will be low, indicating that two lamps are connected to the ballast. Conversely, when the voltage across C10 is less than a second predetermined level, the output of the inverter will be high, indicating that one lamp is connected to the ballast. The output of inverter U1 is connected to a voltage divider consisting of resistors R6 and R7 that is connected to the base of a transistor Q4 so that it will be on when one lamp is connected to the ballast.

A voltage divider consisting of resistors R3 and R4 scales the reference voltage signal provided at terminal 72 by a factor that sets the voltage at the positive input of the error amplifier to a level that that will produce the desired lamp power when two lamps are connected to the ballast. When one lamp is connected to the ballast, transistor Q4 will be on, and a resistor R5 will reduce the voltage at the reference input of U2 so that the ballast output power will be set to a level that is appropriate for one lamp.

If lamp current feedback were used, then the inverter power output level shifting function provided by Q4 and R5 would be unnecessary. Sensing the inverter current with resistor R1, however, is preferable to sensing lamp current because lamp current sensing circuits are often too expensive for many applications.

Electronic ballasts may be designed to operate in an open-loop manner, without lamp current or lamp power feedback. Many ballast circuits are constructed so that if the inverter control circuit operates in an open-loop manner, then the current supplied to one lamp will be somewhat greater than the current supplied to two lamps. In order to provide more consistent lamp operation in open-loop ballasts, the lamp quantity sensor could be used to provide a compensation signal to the inverter control circuit to adjust the inverter frequency, symmetry, or dead time so that the current with one lamp would be the nearly the same as for two lamps.

End-of-lamp-life sensor terminal 24 is connected to ballast output terminal 42 and an end-of-lamp-life sensor 8. Inverter control circuit 20 includes a shutdown trigger 80 that is coupled to terminal 71 for shutting down the ballast, shifting the frequency, or otherwise compensating for a change in the signal at terminal 71. End-of-lamp-life sensors may be constructed to sense various lamp voltage conditions that indicate a lamp has reached the end of its useful life due to degradation of the filaments, and the ballast should be shut down. When a lamp is in an end-of-life state, it will typically conduct current more easily in one direction than the other. This produces a dc offset voltage across the lamp. The peak-to-peak voltage across the lamp increases to a level that is higher than that of normal lamps. The arc voltage may also become unstable.

End-of-lamp-life sensor 8 of the present invention receives both a lamp-life input signal and a lamp quantity signal. End-of-lamp-life sensor 8 utilizes the lamp-life input signal and the lamp quantity signal to allow the life signal voltage at terminal 71 to have a normal value that is independent of the number of lamps connected to the ballast when good lamps are connected to the ballast. When a lamp reaches an end-of-life state, the life signal voltage at terminal 71 rises above the normal value. Thus, a single threshold level may be used by the shutdown trigger 80 regardless of the number of lamps being powered by the ballast. An alternative embodiment may use the output of the lamp quantity sensor to adjust a shutdown trigger 80 having a variable threshold according to the number of lamps detected. The end-of-lamp-life sensor 8 is optional, and is mainly used with lamps that are less than one inch in diameter, because worn out filaments may cause the ends of narrow lamps to overheat.

In the preferred embodiment, the end-of-lamp-life sensor 8 operates as outlined in the following discussion. The voltage between end-of-lamp-life sensing terminal 24 and common terminal 27 is equal to the either the sum of the arc voltages of two lamps, or the arc voltage of one lamp. A charge pump consisting of capacitors C8 and C9, and diodes D1 and D2 produces a voltage that depends on the loading provided by resistors R8 and R9. These resistors R8, R9 form a charge pump load connected to the charge pump. The charge pump load provided by these resistors is controlled by a load switch that changes the charge pump load to produce a consistent life signal that is relatively independent of the number of lamps operated by the ballast. The base of transistor Q3 is connected to the junction of resistors R11 and R12. These resistors are scaled so that Q3 is on only when two operating lamps are connected to the ballast. When the lamp quantity sensor 6 determines that one lamp is present only resistor R9 provides a load for the charge pump. When the lamp quantity sensor 6 determines that two lamps are present, transistor Q3 will be on, and resistor R8 provides an additional load for the charge pump so that the life signal voltage at terminal 71 is relatively independent of the number of lamps operated by the ballast. This allows terminal 71 to be coupled to a trigger circuit (not shown) with a fixed threshold for sensing the increased arc voltage that occurs in an end-of-lamp-life condition.

Fluorescent lamps typically require a starting voltage that is substantially larger than their operating voltage. To prevent the high lamp starting voltage from triggering the shutdown trigger 80 that is coupled to terminal 71, a triggering delay device, implemented by capacitor C8, should be sized to be to cause a sufficient delay in the rise of the life signal voltage at terminal 71 so that false triggering will be avoided.

If other lamp characteristics are sensed to determine end-of-lamp-life such as sensing a dc offset or arc jitter, the life signal output of the end-of-lamp-life sensor may also need to be scaled somewhat to accommodate both one and two lamp situations. These sensing schemes may also require a delay to prevent false triggering. Although the sensing, scaling, and delay circuits shown in FIG. 2 are analog in nature, the same functionality can be readily obtained through the use of digital circuits.

The following paragraph lists component values or part numbers for a ballast operating one or two 40W TT5 lamps. The ballast operating frequency is about 65 kHz. Component values and part numbers are as follows: C7, 1 $\mu$F; D3, 1N4148; R7, 20 k Ohm; C8, 68 $\mu$F; D4, 1N4148; R8, 10 k Ohm; C9, 47 pF; R2, 10 k Ohm; R9, 10 k Ohm; C10, 47 $\mu$F; R3, 182 k Ohm; R10, 1 k Ohm; C11, 47 pF; R4, 105 k Ohm; R11, 10 k Ohm; D1, 1N4148; R5, 66.5 k Ohm; R12, 1 k Ohm; D2, 1N4148; R6, 100 k Ohm; and Q3, Q4, 2N3904. A ballast control integrated circuit such as the L6574 manufactured by ST Microelectronics may provide the gate drive signals, and also include an error amplifier and other circuits such as an inverter power control circuit 75, a shutdown trigger 80, and a voltage reference.

Thus, although there have been described particular embodiments of the present invention of a new and useful Electronic Ballast for One or More Lamps, it is not intended that such references be construed as limitations upon the scope of this invention except as set forth in the following claims.

What is claimed is:

1. An electronic ballast apparatus for powering at least two series connected gas discharge lamps connected at a common point, comprising:

a series resonant tank circuit; and an inverter control circuit electrically connected to the series resonant tank circuit, the inverter control circuit including a lamp quantity sensor connected to the common point and adapted to sense whether one or more lamps are connected to the ballast.

2. The ballast apparatus of claim 1, the lamp quantity sensor including a charge pump.

3. The ballast apparatus of claim 1, the lamp quantity sensor including a time delay device adapted to provide a delay in the operation of the lamp quantity sensor.

4. The ballast apparatus of claim 1, the inverter control circuit further comprising:

an end-of-lamp-life sensor in communication with the lamp quantity sensor and a shutdown trigger.

5. An electronic ballast apparatus for powering at least one gas discharge lamp, comprising:

a series resonant tank circuit;

an inverter control circuit electrically connected to the series resonant tank circuit, the inverter control circuit including a lamp quantity sensor adapted to sense whether one or more lamps are connected to the ballast, the inverter control circuit including an inverter power control circuit; and a regulator circuit connected to the inverter power control circuit, the regulator circuit adapted to regulate lamp power delivered to the at least one gas discharge lamp to be proportional to the number of lamps connected to the ballast.

6. The ballast apparatus of claim 5, the regulator circuit comprising:

an error amplifier including a reference input, a feedback input and an output, wherein the output of the error amplifier is connected to the inverter power control circuit.

7. The ballast apparatus of claim 6, the regulator circuit further comprising:

a reference adjustment circuit adapted to scale a reference signal, the reference adjustment circuit communicating with the lamp quantity sensor and the reference input of the error amplifier.

8. The ballast apparatus of claim 7, the reference adjustment circuit comprising: a threshold detector in communication with the lamp quantity sensor.

9. The ballast apparatus of claim 8, the threshold detector comprising a digital inverter.

10. An electronic ballast apparatus for powering at least one gas discharge lamp, comprising:

a series resonant tank circuit;

an inverter control circuit electrically connected to the series resonant tank circuit, the inverter control circuit including a lamp quantity sensor adapted to sense whether one or more lamps are connected to the ballast; and an end-of-lamp-life sensor in communication with the lamp quantity sensor and a shutdown trigger, wherein the end-of-lamp-life sensor receives both a lamp-life input signal and the lamp quantity signal, the end-of-lamp-life sensor adapted to utilize the lamp-life input signal and the lamp quantity signal to adjust a life signal supplied to the shutdown trigger to sense the end-of-lamp-life condition for one or more lamps.

11. An electronic ballast apparatus for powering at least one gas discharge lamp, comprising:

a series resonant tank circuit;

an inverter control circuit electrically connected to the series resonant tank circuit, the inverter control circuit including a lamp quantity sensor adapted to sense whether one or more lamps are connected to the ballast; and an end-of-lamp-life sensor in communication with the lamp quantity sensor and a shutdown trigger, the end-of-lamp-life sensor comprising:

a charge pump; and a charge pump load connected to the charge pump.

12. The ballast apparatus of claim 11, wherein the charge pump load is controlled to produce a consistent life signal that is relatively independent of the number of lamps operated by the ballast.

13. An electronic ballast apparatus for powering at least one gas discharge lamp, comprising:

a series resonant tank circuit;

an inverter control circuit electrically connected to the series resonant tank circuit, the inverter control circuit including a lamp quantity sensor adapted to sense whether one or more lamps are connected to the ballast; and an end-of-lamp-life sensor in communication with the lamp quantity sensor and a shutdown trigger, the end-of-lamp-life sensor comprising:

a triggering delay device adapted to provide a sufficient delay to avoid false triggering.

14. An electronic ballast apparatus for powering two or more gas discharge lamps series connected to include at least one common point, comprising:

an inverter control circuit that includes a lamp quantity sensor that determines how many lamps are connected to the ballast and provides a lamp quantity signal, the lamp quantity sensor connected to the at least one common point;

the inverter control circuit adapted to utilize the lamp quality signal for adjusting ballast operating characteristics in order to operate the lamps under nearly the same operating conditions regardless of the number of lamps connected.

15. The electronic ballast apparatus of claim 14, the inverter control circuit including a regulator circuit, wherein the lamp quantity sensor is adapted to adjust a reference input to the regulator circuit, the regulator circuit is adapted to regulate the total power delivered by the inverter to the lamps to be proportional to the number of lamps connected to the ballast.

16. The electronic ballast apparatus of claim 14, the inverter control circuit including an end-of-lamp-life sensor, wherein the end-of-lamp-life sensor is adapted to adjust operation in accordance with the lamp quantity signal.

17. A ballast control circuit for operating two or more lamps under nearly the same operating conditions, the lamps series connected to include at least one common point comprising:

a lamp quantity sensor with a lamp quantity signal output, the lamp quantity sensor connected to the common point and adapted to detect whether one or more lamps are connected to the ballast; and an inverter in communication with the lamp quantity sensor, the inverter operable to use the output of the lamp quantity sensor to maintain essentially the same lamp current regardless of the number of lamps.

18. The ballast control circuit of claim 17, further comprising:

an end-of-lamp-life sensor electrically connected to the lamp quantity sensor, the end-of-lamp-life sensor adapted to sense an end-of-lamp-life condition for the at least one lamp.

19. A ballast control circuit for operating at one or more lamps under nearly the same operating conditions, comprising:

a lamp quantity sensor with a lamp quantity signal output, the lamp quantity sensor adapted to detect whether one or more lamps are connected to the ballast;

an inverter in communication with the lamp quantity sensor, the inverter operable to use the output of the lamp quantity sensor to maintain essentially the same lamp current regardless of the number of lamps;

a reference adjustment circuit for providing a scaled reference signal, wherein the reference adjustment circuit is in communication with the lamp quantity sensor; and an error amplifier including a reference input, a feedback input, and an error amplifier output, wherein the reference output of the reference adjustment circuit is in communication with the reference input of the error amplifier.

20. The ballast control circuit of claim 19, further comprising:

an inverter power control circuit adapted to utilize the output of the error amplifier to regulate the total power delivered by the inverter to be proportional to the number of lamps connected to the ballast.

* * * * *